US007425686B1

(12) United States Patent
Reed et al.

(10) Patent No.: US 7,425,686 B1
(45) Date of Patent: Sep. 16, 2008

(54) FOUR-WAY ROCKER SWITCH

(75) Inventors: Glenn Reed, Ann Arbor, MI (US); Terry L. Padgett, New Boston, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 92 days.

(21) Appl. No.: 11/626,978

(22) Filed: Jan. 25, 2007

(51) Int. Cl.
*H01H 25/04* (2006.01)

(52) U.S. Cl. ..... 200/6 A; 200/5 R

(58) Field of Classification Search ..... 200/4, 200/5 R, 6 A, 17 R, 18; 74/471; 341/20–22, 341/35; 345/156, 157, 160, 161, 168, 169, 345/184

See application file for complete search history.

(56) References Cited

U.S. PATENT DOCUMENTS 4,975,547 A 12/1990 Nakayama et al.
5,038,086 A 8/1991 Ahmed et al.
5,619,195 A * 4/1997 Allen et al. ..... 341/20
5,691,517 A * 11/1997 Yamamoto et al. ..... 200/6 A
5,698,825 A 12/1997 Karasik
5,744,765 A * 4/1998 Yamamoto ..... 200/6 A
6,462,731 B1 * 10/2002 Stoffers et al. ..... 345/161
6,504,115 B2 * 1/2003 Nakai ..... 200/6 A
6,657,141 B1 12/2003 Myojin
6,756,556 B2 6/2004 Kubota et al.
6,762,372 B2 * 7/2004 Nishimoto et al. ..... 200/4
6,781,076 B2 * 8/2004 Takiguchi et al. ..... 200/316
6,787,716 B1 * 9/2004 Menche ..... 200/6 A
2002/0041273 A1 4/2002 Dirksen et al.
2003/0035052 A1 2/2003 Baron
2004/0143372 A1 7/2004 Taxis
2005/0021190 A1 1/2005 Worrell et al.

* cited by examiner

*Primary Examiner*—Michael A Friedhofer
(74) *Attorney, Agent, or Firm*—Frank A. MacKenzie; Brooks Kushman P.C.

(57) ABSTRACT

A multiple contact switch assembly is provided and may be characterized as a four-way rocker switch or as a two axis rocker switch. The switch assembly comprises a rocker body that is supported on a carrier bridge for pivotal movement about one axis. The carrier bridge and rocker body subassembly is attached to a pocket in a bezel for pivotal movement about an axis that is perpendicular to the axis about which the rocker body pivots relative to the carrier bridge. A button face of the rocker body contacts a switch contact dome when the button face is contacted in one of the four quadrants. Contacting the button face between two quadrants is ineffective to make contact with any of the switch contact domes.

17 Claims, 3 Drawing Sheets

FOUR-WAY ROCKER SWITCH

BACKGROUND OF THE INVENTION

1. Field of the Invention

An actuator assembly for a multiple contact switch that may be closed by pressing on one of four quadrants of a push button.

2. Background Art

Multiple contact switches may be used to control multiple functions with a single switch assembly. An example of such a switch is a seek/scan switch for a tuner of a radio. Such a switch may allow a user to push an upper quadrant of the actuation button to seek a higher frequency station and to push a lower quadrant to seek a lower frequency station. The switch may also allow a user to push a right side quadrant to tune the radio to a higher frequency or a left side quadrant to tune to a lower frequency. Multiple contact switches may also be used in many other applications such as DVD players, televisions, navigation systems, video games, and the like.

Prior art designs for multiple contact switches tend to be complex and expensive. In addition, problems may be encountered if prior art switches are contacted at the corners or in another area that spans two or more quadrants. Contacting the push button actuator in the center may result in actuation of multiple contacts or unintended actuation of a contact.

Switch sensitivity is one parameter used to specify actuator performance. Insufficient switch travel actuation distance may render a switch too sensitive and subject to unintended actuations. Excessive switch travel actuation distance may render a switch difficult to operate.

There is a need for a simple and economical multiple contact switch assembly that solves the above problems associated with prior art switches as summarized below.

SUMMARY OF THE INVENTION

A four-way rocker switch is provided that includes a support base, a carrier bridge assembled to the support base and a rocker body that is assembled to the carrier bridge. The carrier bridge is connected to the support base by a first single axis pivot connector to pivot about a first pivot axis. The carrier bridge has first and second carrier bridge switch contact pads that are located to engage first and second switch contacts. The rocker switch is connected to the carrier by a second single axis pivot connector to pivot about the second pivot axis that is perpendicular to the first pivot axis. The rocker switch has first and second rocker switch contact pads that are arranged to engage third and fourth switch contacts are attached. The rocker switch has a button portion that is adapted to be contacted by an operator's finger to actuate the switch. The switch contacts are selectively actuated by pressing the button in one of an up, down, right, and left quadrant.

Other features of the four-way rocker switch may include that the support base is part of a bezel of a control panel for an infotainment apparatus. The first single axis pivot connector may include first and second pins that extend inwardly from a switch receptacle pocket formed on the support base. The pins are received in first and second receptacle holes formed in the carrier bridge, with the first and second pins being aligned with the first pivot axis. The second single axis pivot connector may include third and fourth pins that extend outwardly from the rocker body and are received in the third and fourth receptacle holes formed in the carrier bridge. The third and fourth pins are aligned with the second pivot axis.

The rocker body has at least one alignment flange that extends outwardly from a wall of a rocker body. The alignment flange is received in the alignment slot formed in one side of the carrier bridge. If desired, four alignment flanges may be provided that are each received in one of two alignment slots formed in each of the two sides of the carrier bridge. The alignment flange may extend through the carrier flange and may be received in a slot formed in the support base to constrain the motion of the rocker body to pivot about the first pivot axis.

The first and second rocker switch contact pads may extend outwardly from the rocker body and may be received in the first and second slots formed on the carrier bridge to interlock the rocker body to the carrier flange. The support base may have pocket for receiving the rocker switch. The pocket may be defined by four walls that extend perpendicular to the plane in which the support base is disposed.

Alternatively, a two axis rocker switch is provided that includes an actuation button, a carrier and a bezel. The carrier receives the actuation button within the carrier. The bezel receives the carrier and the actuation button that are assembled together. A first pivot connection assembly is provided between the actuation button and the carrier that permits the actuation button to pivot relative to the carrier about an axis A. A second pivot connection assembly is provided between the carrier and the bezel that permits the carrier and the actuation button to pivot relative to the bezel about an axis B. Axis B is substantially perpendicular to axis A.

Further features of the two axis rocker switch may comprise providing a first pivot connection assembly that includes a pair of pivot engagement members that are associated with the actuation button. The pivot engagement members are received by a pair of pivot engagement members associated with the carrier bridge. The two pairs of pivot engagement members are aligned with the pivot axis A. The second pivot connection assembly may include a pair of pivot connection members that are associated with the carrier bridge. The pair of pivot engagement members are received by a pair of pivot engagement members formed in the bezel. The pair of pivot engagement members associated with the bezel and the pair of pivot engagement members associated with the carrier bridge are aligned with the pivot axis B.

The actuation button may have at least one guide flange that extends outwardly from a wall of the actuation button so that each guide flange is received in a guide slot formed in one side of the carrier bridge. Further, four guide flanges may be provided that extend from two oppositely oriented walls of the actuation button. The four guide flanges are each received in one of two guide slots formed in each of two sides of the carrier bridge. The guide flange may also extend through the carrier flange to be received in a slot formed in the support base that constrains the motion of the actuation button to pivot about the first pivot axis.

The first and second rocker switch contact pads may extend outwardly from the actuation button and are received in first and second slots formed on the carrier bridge to interlock the actuation button to the carrier flange. The support base may have a pocket for receiving the rocker switch wherein the pocket is defined by four walls that extend perpendicular to a plane in which the support base in disposed.

The above features and elements of the four-way rocker switch or two axis rocker switch will be better understood in view of the attached drawings and the following detailed description.

DETAILED DESCRIPTION OF THE PREFERRED EMBODIMENT(S)

Figure 1:
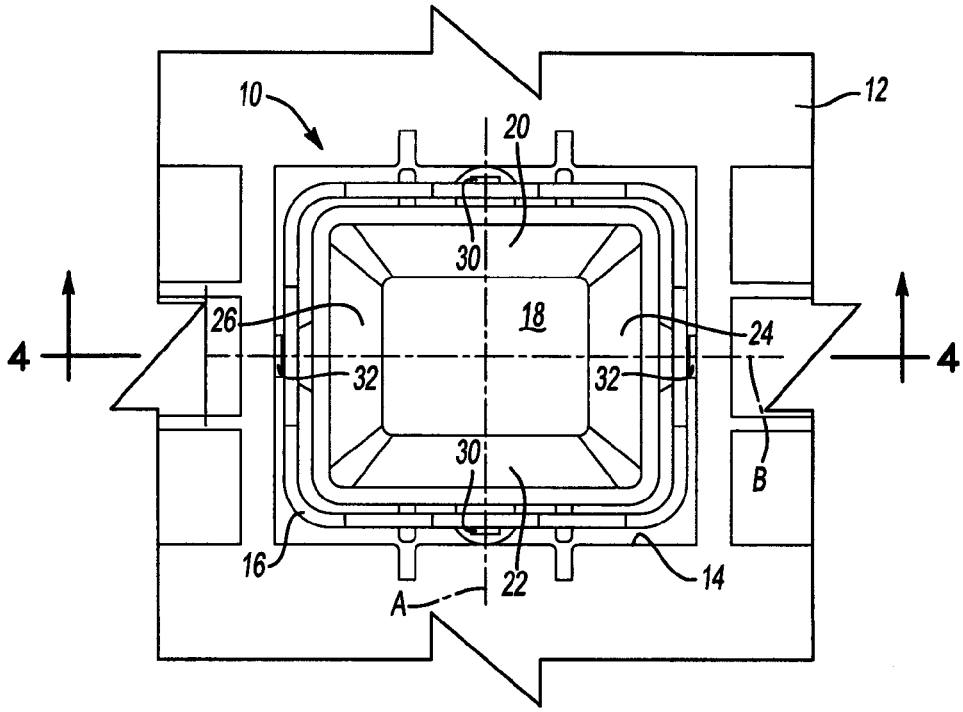
FIG. 1 is a fragmentary plan view of a multiple contact switch actuator.

Referring to FIG. 1, a switch assembly 10 is shown disposed on a bezel 12, or support base, within a pocket 14 formed in the bezel 12. The switch assembly 10 includes a carrier bridge 16 and a rocker body 18, or push button. A rocker body 18 is divided into four quadrants that are divided generally along diagonal lines that extend through the corners of the push button 18. The push button 18 may be used to control a four-way switch such as the type of switch used to control a seek, scan or tuning function of a radio. The first quadrant 20 may correspond to a up orientation for a seek function while the second quadrant 22 may correspond to a down command for the seek function. The third quadrant 24, or right side, may be used to control the tuning or scan function in one direction with the fourth quadrant 26 being used to control the left side function of the tuning or scan function.

A first pair of pivot connectors 30 may be used to secure the rocker body 18 to the carrier bridge 16 and are aligned on a axis A. A second pair of pivot connectors 32 connect the carrier bridge 16 to the pocket 14 in the bezel 12. The second pair of pivot connectors are aligned with an axis B. The rocker body 18 pivots relative to the carrier bridge 16 about axis A. The assembled rocker body 18 and carrier bridge 16 pivot about axis B relative to the bezel 12.

Figure 2:
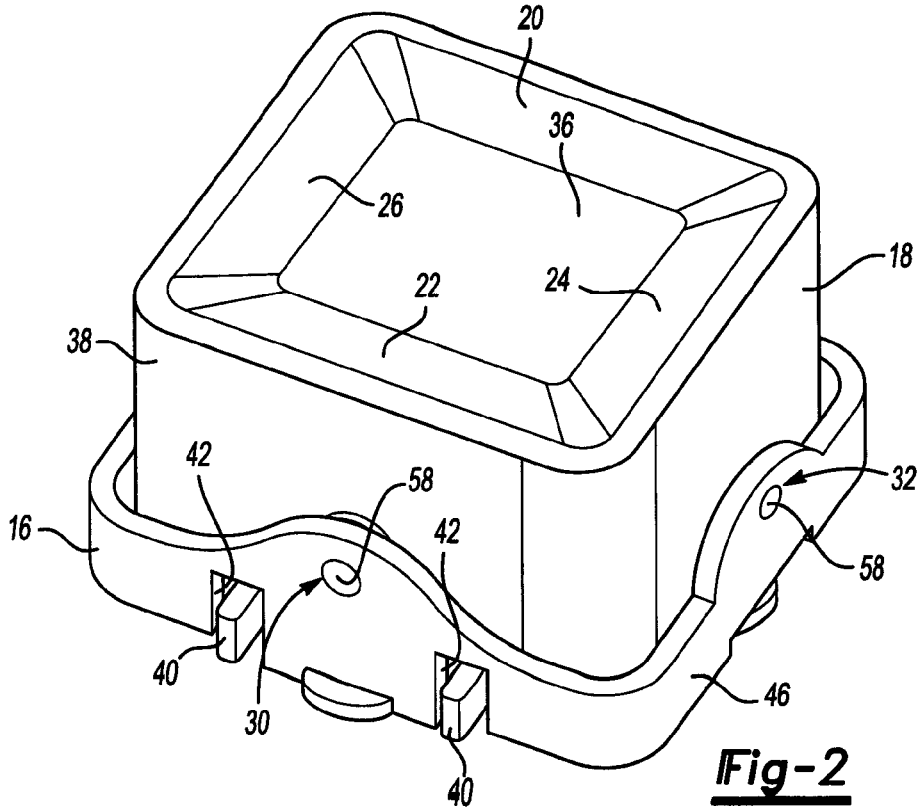
FIG. 2 is a perspective view of a carrier bridge and rocker body that are assembled together.
Figure 3:
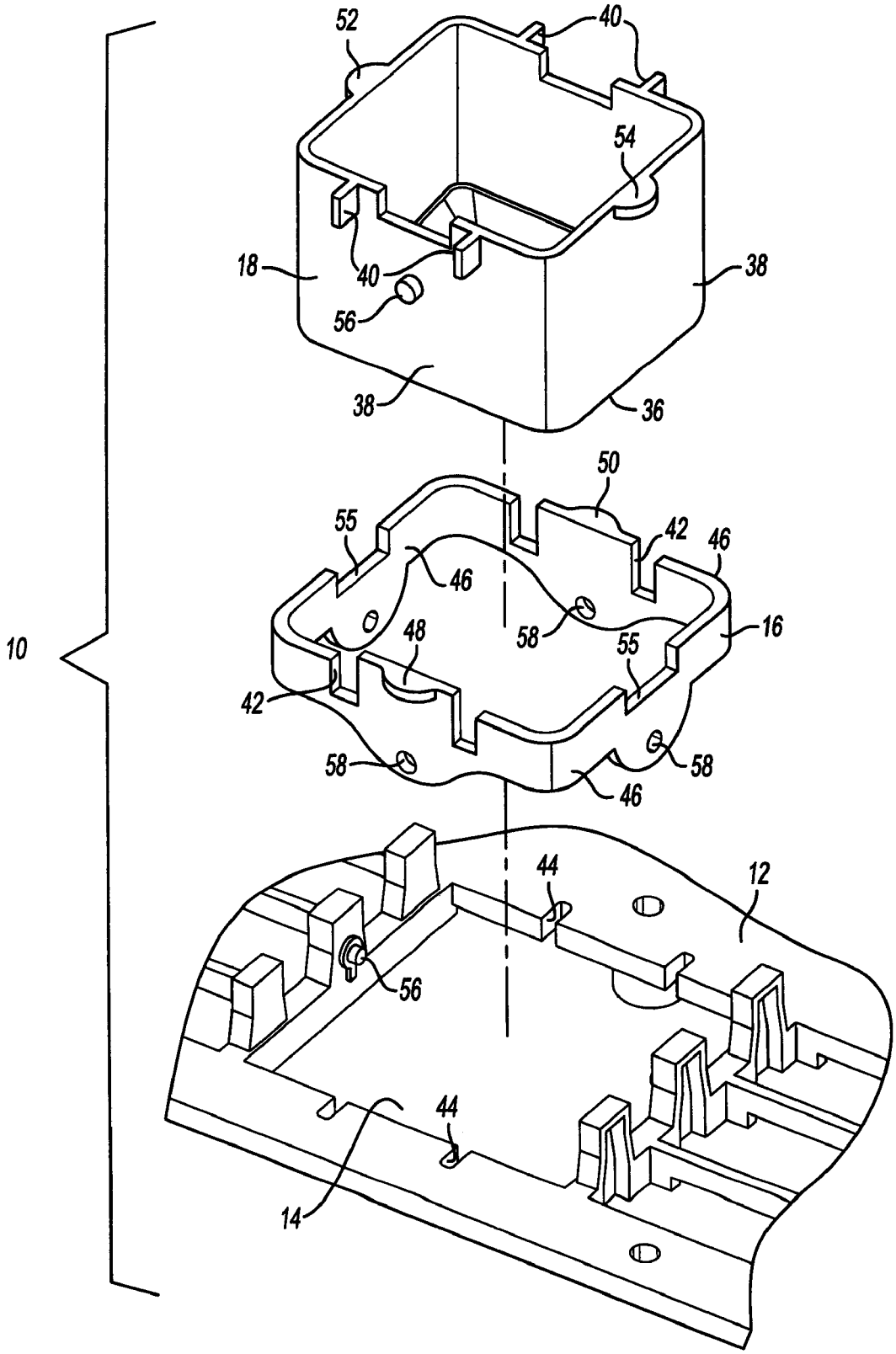
FIG. 3 is an inner perspective view of a carrier bridge and rocker body and a bezel shown in fragmentary perspective.

Referring to FIGS. 2 and 3, the rocker body 18, or push button, is shown to include a button face 36 that is intended to be engaged by a user's finger to actuate the switch. The rocker body 18 also includes four side walls 38 that are each joined at one end to the button face 36. The rocker body 18 is shown assembled to the carrier bridge 16 in FIG. 2 in isolation from the bezel 12. The rocker body 18 is pivotable relative to the carrier bridge 16 about the first pair of pivot connectors 30.

The rocker body 18 has four guide tabs 40 that are provided on two of the four side walls 38. The guide tabs 40 are received in correspondingly located guide slots 42. Bezel slots 44 are formed in the bezel 12. The bezel slots 44 receive the ends of the guide tabs 40 that extend outboard of the guide slots 42 in the carrier bridge 16. When either of the first quadrant 20 or second quadrant 22 are contacted, two of the guide tabs 40 engage two of the four guide slots 42 in the carrier bridge 16 and with two of the four bezel slots 44 in the bezel 12. The guide tabs 40 constrain the motion of the rocker body 18 to pivot only about axis A.

When the button face 36 is contacted in the third quadrant 24 or fourth quadrant 26 the four projection features on the rocker body 18 slide against vertical walls on the bezel. This constrains motion of the rocker body 18 to pivot only about axis B.

The carrier bridge 16 has four sides 46 that are disposed adjacent the four side walls 38 of the rocker body 18. The carrier bridge 16 includes an up pad 48 and a down pad 50. The rocker body 18 also includes a right pad 52 and a left pad 54. The pads 48-54 are used to engage corresponding switch contacts, as will be more specifically described below with reference to FIG. 5. Right pad 52 and left pad 54 are received within slots 55 formed on the carrier bridge 16 to interlock the carrier bridge 16 to the rocker body 18.

Figure 4:
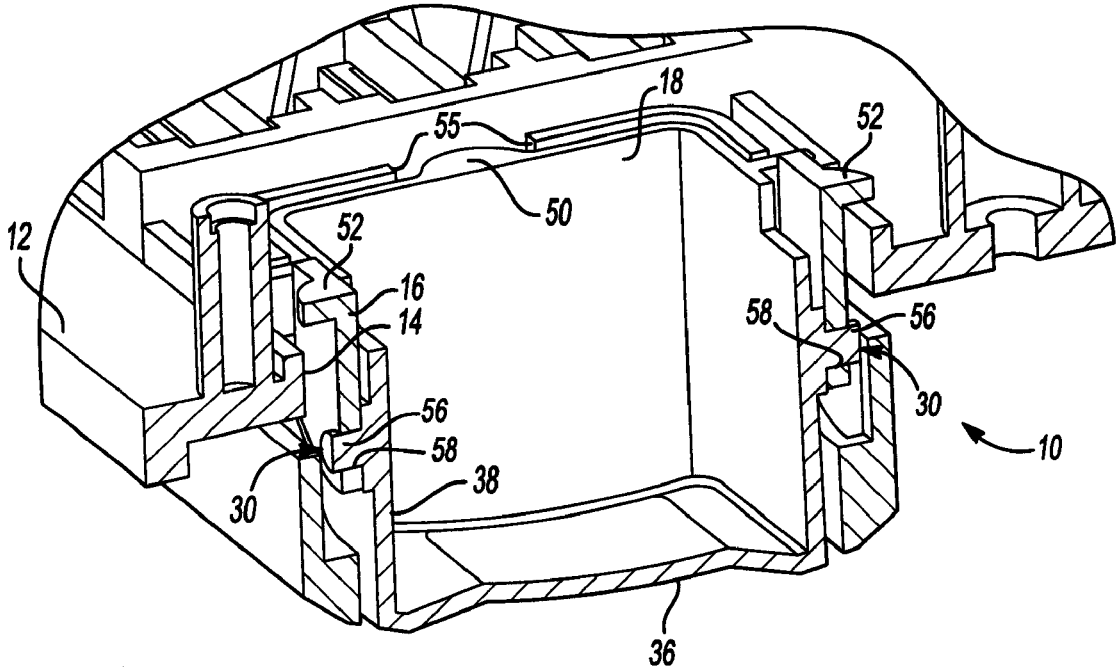
FIG. 4 is a cross-sectional and perspective view taken along the line 4-4 in FIG. 1.

Referring to FIGS. 2 through 4, the structure of the first and second pairs of pivot connectors 30 and 32 is described in greater detail. Each of the pivot connectors includes a post 56 that is received within a hole 58. The first pair of pivot connectors 30 each include a post 56 that extends outwardly from one of the side walls 38 of the rocker body 18 and into a hole 58 formed in the carrier bridge 16. The second pair of pivot connectors 32 is similar to the structure of the first pair of pivot connectors. The second pair of pivot connectors include a post 56 that is provided on the pocket 14 that extends inwardly into the hole 58 formed in the carrier bridge 16. Whichever quadrant of the button face 36 is contacted results in movement of one of the pads 48-54.

Figure 5:
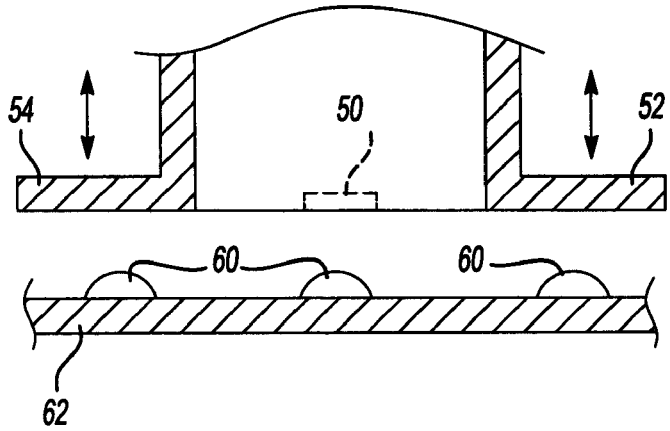
FIG. 5 is a fragmentary cross-sectional view taken through two of the contact pads and the contact dome.

Referring to FIG. 5, contact pads 52 and 54 are each disposed above in a spaced relationship relative to switch contact dome 60. The switch contact domes 60 are provided on a switch mat 62. The bezel 12 is assembled over the switch mat 62. Right pad 52 and left pad 54 contact a switch contact dome 60 when the button face 36 is contacted in the quadrant above the respective pads. Also shown in phantom lines, is the down pad 50 that contacts another switch contact dome 60 when the button face 36 is contacted above the down pad 50.

While the best mode for carrying out the invention has been described in detail, those familiar with the art to which this invention relates will recognize various alternative designs and embodiments for practicing the invention as defined by the following claims.

What is claimed is:

1. A four-way rocker switch, comprising:

a support base;

a carrier bridge is assembled to the support base, the carrier bridge being connected to the support base by a first single axis pivot connector to be pivoted about a first pivot axis, the carrier bridge having first and second carrier bridge switch pads that are oriented to actuate first and second switch contacts, the carrier bridge having a side that defines an alignment slot;

a rocker body is assembled to the carrier bridge, the rocker body being connected to the carrier bridge by a second single axis pivot connector to be pivoted about a second pivot axis that is perpendicular to the first pivot axis, the rocker body having first and second rocker switch contact pads that are oriented to actuate third and fourth switch contacts, the rocker body has at least one alignment flange that extends outwardly from a wall of the rocker body that is received in the alignment slot, the rocker body has a button portion that is contacted by an operator's finger to actuate the switch; and wherein the first, second, third, and fourth switch pads are selectively actuated by pressing the button portion in an up, down, right, and left quadrants, respectively.

2. The four-way rocker switch of claim 1 wherein the support base is part of a bezel of a control panel for an infotainment apparatus.

3. The four-way rocker switch of claim 1 wherein the first single axis pivot connector includes first and second pins that extend inwardly from a switch receptacle pocket formed on the support base and are received in first and second receptacle holes formed in the carrier bridge, wherein the first and second pins are aligned with the first pivot axis.

4. The four-way rocker switch of claim 1 wherein the second single axis pivot connector includes third and fourth pins that extend outwardly from the rocker body and are received in third and fourth receptacle holes formed in the carrier bridge, wherein the third and fourth pins are aligned with the second pivot axis.

5. The four-way rocker switch of claim 1 wherein four alignment flanges are provided that extend outwardly from two oppositely oriented walls of the rocker body and wherein the four alignment flanges are each received in one of two alignment slots formed in each of two sides of the carrier bridge.

6. The four-way rocker switch of claim 1 wherein the at least one alignment flange extends through a carrier flange and is received in a slot formed in the support base to constrain the motion of the rocker body to pivot about the first pivot axis.

7. A four-way rocker switch, comprising:

a support base;

a carrier bridge is assembled to the support base, the carrier bridge being connected to the support base by a first single axis pivot connector to be pivoted about a first pivot axis, the carrier bridge having first and second carrier bridge switch pads that are oriented to actuate first and second switch contacts, the carrier bridge having a side that defines an alignment slot;

a rocker body is assembled to the carrier bridge, the rocker body being connected to the carrier bridge by a second single axis pivot connector to be pivoted about a second pivot axis that is perpendicular to the first pivot axis, the rocker body having first and second rocker switch contact pads that are oriented to actuate third and fourth switch contacts, wherein the first and second rocker switch pads extend outwardly from the rocker body and are received in first and second slots formed on the carrier bridge to interlock the rocker body to the carrier flange, the rocker body has at least one alignment flange that extends outwardly from a wall of the rocker body that is received in the alignment slot, the rocker body has a button portion that is contacted by an operator's finger to actuate the switch; and wherein the first, second, third, and fourth switch pads are selectively actuated by pressing the button portion in an up, down, right, and left quadrants, respectively.

8. The four-way rocker switch of claim 1 wherein the support base has a pocket for receiving the rocker switch, and wherein the pocket is defined by four walls that extend perpendicular to a plane in which the support base in disposed.

9. A four-way rocker switch, comprising:

a support base wherein the support base has a pocket defined by four walls that extend perpendicular to a plane in which the support base in disposed;

a carrier bridge is assembled to the support base, the carrier bridge being connected to the support base by a first single axis pivot connector to be pivoted about a first pivot axis, the carrier bridge having first and second carrier bridge switch pads that are oriented to actuate first and second switch contacts, the carrier bridge having a side that defines an alignment slot;

a rocker body is assembled to the carrier bridge, the rocker body being connected to the carrier bridge by a second single axis pivot connector to be pivoted about a second pivot axis that is perpendicular to the first pivot axis, the rocker body having first and second rocker switch contact pads that are oriented to actuate third and fourth switch contacts, the rocker body has at least one alignment flange that extends outwardly from a wall of the rocker body that is received in the alignment slot, the rocker body has a button portion that is contacted by an operator's finger to actuate the switch;

wherein the first, second, third, and fourth switch pads are selectively actuated by pressing the button portion in an up, down, right, and left quadrants, respectively; and wherein four alignment flanges are provided that extend outwardly from two oppositely oriented walls of the rocker body and wherein the four alignment flanges are each received in one of four alignment slots formed in two sides of the carrier bridge, and wherein the four alignment flanges each extend through one of the four alignment slots in the carrier bridge and are received in four slots formed in two of the walls of the support base to constrain the motion of the rocker body as the rocker body pivots.

10. A two axis rocker switch comprising:

an actuation button that has at least one guide flange that extends outwardly from a wall of the actuation button;

a carrier that receives the actuation button within the carrier, the carrier having a side that defines a guide slot;

a bezel for an electronic apparatus that receives the carrier and the actuation button;

a first pivot connection assembly between the actuation button and the carrier that permits the actuation button to pivot relative to the carrier about an axis A;

a second pivot connection assembly between the carrier and the bezel that permits the carrier and the actuation button to pivot relative to the bezel about an axis B, wherein axis B is substantially perpendicular to axis A; and wherein the guide flange is received in a guide slot formed in one side of the carrier.

11. The two axis rocker switch of claim 10 wherein the first pivot connection assembly includes a pair of pivot engagement members that are associated with the actuation button and are received by a pair of pivot engagement members associated with the carrier, wherein the pair of pivot engagement members associated with the actuation button and the pair of engagement members associated with the carrier are aligned with the pivot axis A.

12. The two axis rocker switch of claim 10 wherein the second pivot connection assembly includes a pair of pivot engagement members that are associated with the carrier and are received by a pair of pivot engagement members formed in the bezel, wherein the pair of pivot engagement members associated with the bezel and the pair of engagement members associated with the carrier are aligned with the pivot axis B.

13. The two axis rocker switch of claim 10 wherein four guide flanges are provided that extend outwardly from two oppositely oriented walls of the actuation button and wherein the four guide flanges are each received in one of two guide slots formed in each of two sides of the carrier bridge.

14. The two axis rocker switch of claim 10 wherein the guide flange extends through the carrier and is received in a slot formed in the support base to constrain the motion of the actuation button to pivot about the first pivot axis.

15. The two axis rocker switch of claim 10 wherein the support base has a pocket for receiving the rocker switch, and wherein the pocket is defined by four walls that extend perpendicular to a plane in which the support base in disposed.

16. A two axis rocker switch comprising:

an actuation button;

a carrier that receives the actuation button within the carrier;

a bezel for an electronic apparatus that receives the carrier and the actuation button;

a first pivot connection assembly between the actuation button and the carrier that permits the actuation button to pivot relative to the carrier about an axis A;

a second pivot connection assembly between the carrier and the bezel that permits the carrier and the actuation button to pivot relative to the bezel about an axis B, wherein axis B is substantially perpendicular to axis A; and first and second rocker switch contact pads extend outwardly from the actuation button and are received in first and second slots formed on the carrier to interlock the actuation button to the carrier flange.

17. A two axis rocker switch comprising:

an actuation button;

a carrier that receives the actuation button within the carrier;

a support base for an electronic apparatus that receives the carrier and the actuation button;

a first pivot connection assembly between the actuation button and the carrier that permits the actuation button to pivot relative to the carrier about an axis A;

a second pivot connection assembly between the carrier and the bezel that permits the carrier and the actuation button to pivot relative to the bezel about an axis B, wherein axis B is substantially perpendicular to axis A;

wherein the support base has a pocket defined by four walls that extend perpendicular to a plane in which the support base in disposed, wherein four guide flanges are provided that extend outwardly from two oppositely oriented walls of the actuation button and wherein the four guide flanges are each received in one of four guide slots formed in two sides of the carrier, and wherein the four guide flanges each extend through one of the four guide slots in the carrier and are received in four slots formed in two of the walls of the support base to constrain the motion of the actuation button as the actuation button pivots about the first pivot axis.

* * * * *